United States Patent [19]

Suvak

[11] Patent Number: 4,989,927

[45] Date of Patent: Feb. 5, 1991

[54] CONVERTIBLE DRESSER

[75] Inventor: William S. Suvak, Salem, Ind.

[73] Assignee: Smith Cabinet Manufacturing Company, Inc., Salem, Ind.

[21] Appl. No.: 440,709

[22] Filed: Nov. 24, 1989

[51] Int. Cl.[5] ..... A47B 83/00

[52] U.S. Cl. ..... 312/277; 312/282; 312/293

[58] Field of Search ..... 312/282, 293, 235.1, 312/237, 277, 278, 279; 108/62

[56] References Cited

U.S. PATENT DOCUMENTS

| | | | |
|---|---|---|---|
| 146,390 | 1/1874 | Harrison | 312/282 |
| D. 148,826 | 2/1948 | Spence . | |
| 196,736 | 10/1877 | Ziegler | 312/282 |
| D. 200,475 | 3/1965 | Fortson . | |
| 318,132 | 5/1885 | Peek | 312/282 |
| 1,014,831 | 1/1912 | Long . | |
| 1,369,577 | 2/1921 | Townley . | |
| 3,703,324 | 11/1972 | Smith . | |

*Primary Examiner*—Kenneth J. Dorner
*Assistant Examiner*—Gerald A. Anderson
*Attorney, Agent, or Firm*—Barnes & Thornburg

[57] ABSTRACT

A front cabinet door, attached to the first and second side panels for swinging movement therebetween, so that said front cabinet door can assume an open position with a substantially horizontal orientation parallel to the flippable board and a closed position vertically oriented perpendicular to the flippable board.

3 Claims, 1 Drawing Sheet

CONVERTIBLE DRESSER

FIELD OF THE INVENTION

This invention relates to dressers that can be converted into dressing tables. The invention is more particularly concerned with dressers having a flippable top surface that can be converted into a dressing table for infants.

BACKGROUND AND SUMMARY OF THE INVENTION

The usefulness of furniture such as dressers, cabinets, or bureaus can be greatly increased by providing a hinged or otherwise attached top which can be configured to provide greater working space or allow access to interior regions of the cabinet. For example, both U.S. Pat. No. 1,369,577 to Townley and U.S. Pat. No. 3,703,324 to Smith describe furniture having hinged tops that open to provide an increased working surface. Townley '577 describes a kitchen cabinet having a hinged top which can be opened to provide increased working space but when closed presents the appearance of a standard cabinet. Smith '324 discloses a cabinet having a top surface that is hingeably mounted to form either a flat dressing table for infants or alternatively to form a recessed shelf with side and top panels.

Both the cabinets described by Townley '577 and Smith '324 have an inherent disadvantage associated with the required cost and additional labor needed to add hinges to the cabinets to swingably support the top panel in an opened position.

It is therefore an object of the present invention to provide a dressing table that can be interchangeably converted into a cabinet.

It is another object of this invention to provide a convertible dresser having a front cabinet door and a flippable board configured to form a cabinet top so that the cabinet can be converted into a dressing table by rotating the front cabinet door into a horizontal position and reversing the orientation of the flippable board to bring flippable board into a horizontal position adjacent to the front cabinet door, forming an extensive level surface for use as a dressing table.

Yet another object of this invention is to provide a convertible dresser having a cabinet with front, back, and side panels, a front cabinet door with an upper portion curved toward the back panel of the cabinet, and a flippable board configured to form a cabinet top so that the cabinet can be converted into a dressing table by rotating the front cabinet door into a horizontal position and reversing the orientation of the flippable board to bring flippable board into a horizontal position adjacent to the front cabinet door, forming an extensive level surface surrounded in part by the back panel, side panels, and curved upper portion of the front cabinet door.

In accordance with the previous objectives, the present invention is a cabinet that can be converted into a dressing table. The cabinet has a cabinet body having first and second side panels that are interconnected in a spaced apart relationship. A front cabinet door is attached to the first and second side panels for swinging movement therebetween. The cabinet also includes a flippable board having a first and second surface that rests upon the cabinet body. The flippable board has first and second supports attached to the first surface and arranged in spaced apart relationship so that the flippable board is capable of assuming two orientations with respect to the cabinet body, respectively oriented in a first arrangement with the second surface of the flippable board positioned to form a cabinet top of the cabinet body and in a second orientation with the first surface positioned in a coplanar, adjacent relationship with the front cabinet door placed in an extended position to project horizontally outward from the first and second side panels.

In preferred embodiments the cabinet body is formed by first and second side panels vertically arranged in parallel spaced apart relationship and connected together with a back panel. In the cavity of the cabinet body defined by the conjunction of the first and second side panels and the back panel are positioned a plurality of drawers that are slidably movable in a horizontal plane outward from the back panel to extend from the cabinet body. A top support board is positioned above the plurality of drawers in a horizontal plane extending between the first and second side panels and the back panel to constitute an uppermost horizontal surface. In preferred embodiments the top support board is situated between the first and second side panels and the back panel so that the side and back panels continue to extend upward from the site of horizontally arranged attachment of the top support board.

The flippable board can be placed to rest upon the top support board in two differing orientations. In one orientation the flippable board is positioned so that it is supported by first and second supports to define a space between the first surface of the flippable board and the top support board. In a second orientation, the flippable board is positioned to rest upon the top support board so that a flat surface suitable for a dressing table is provided.

A useful feature of the present invention is the lack of hinge elements or actively movable support members necessary for converting the dresser into a dressing table. Converting from a configuration suitable for a dresser with a top to a dressing table only requires that the flippable board be inverted so that the flippable board is in direct contact with the top support board. Similarly, converting from a dressing table into a dresser involves reversing the procedure, inverting the flippable board so that it is supported by first and second supports which create a storage space between the flippable board and the top support board.

Yet another advantage of the present invention is realized by the increased area of dressing table made available by extending the front cabinet door. The front cabinet door can be swung forward by rotation about pins that attach the front cabinet door between the first and second side panels. The forward rotation of the front cabinet door forward is blocked in a horizontal position by the action of blocks set on the first and second side panels so that a substantially flat surface located adjacent and coplanar to the flippable board is created. The combination of the properly oriented flippable board and front cabinet door together form a substantially flat surface suitable for use as a dressing table.

Still another advantage of the present invention results from the positioning of the top support board at a predetermined distance below the upper edges of the front, side and back panels. When the flippable board is oriented to act as a dressing table, the predetermined distance of first and second side panels and back panel act as a barrier to better contain the movements of infants or objects placed upon the dressing table. This advantage is also promoted by providing the front cabinet door with an curved portion that upwardly extends in a generally vertical manner when the remaining flat portion of the front cabinet door is in an extended horizontal position.

Additional features and advantages of the invention will become apparent to those skilled in the art upon consideration of the following detailed description of a preferred embodiment exemplifying the best mode of carrying out the invention as presently perceived. The detailed description particularly refers to the accompanying drawings.

DESCRIPTION OF THE PREFERRED EMBODIMENT

Figure 1:
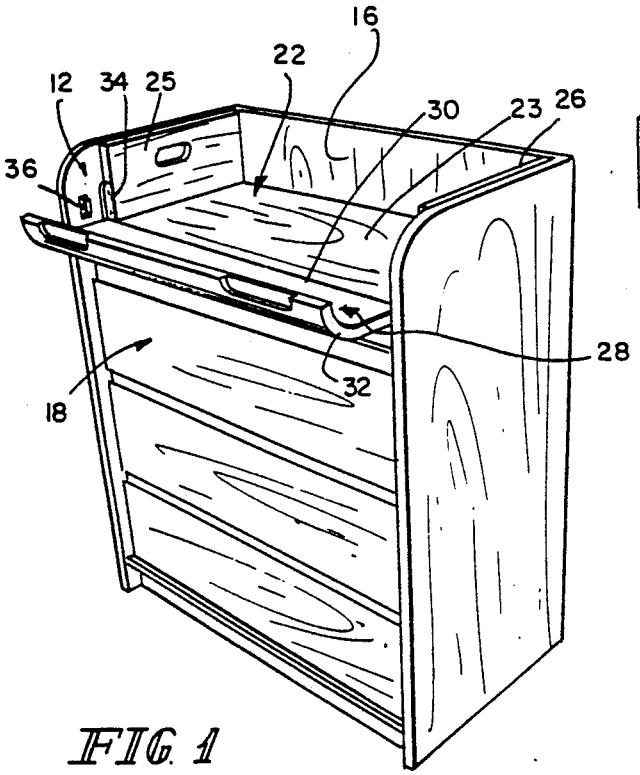
FIG. 1 is a perspective view of a dresser that can be converted into a dressing table.

A convertible dresser 10 in accordance with the present invention is illustrated in whole or in part in FIGS. 1 through 4. The convertible dresser 10 includes a cabinet body 11 formed from a first side panel 12 and a second side panel 14. The first and second side panels 12 and 14 are arranged vertically arranged in a parallel spaced apart relationship. They are connected by a back panel 16 that is vertically arranged in perpendicular attachment to both the first and second side panels 12 and 14.

Disposed between the side panels 12 and 14 are a plurality of drawers 18. Each drawer 18 can be extended outward from the cabinet body 11 to allow access to the interior space (not shown) of the drawers 18. Also situated between the first and second side panels 12 and 14 is a top support board 20. The top support board 20 is arranged to horizontally lie between the first and second side panels 12 and 14.

Resting atop the top support board 20 is a flippable board 22. The flippable board 22 has a first surface 23 and a second surface 24. Attached perpendicularly to the first surface 23 are a first support 25 and a second support 26. The first and second supports 25 and 26 are arranged in parallel spaced apart relationship with respect to each other.

Figure 2:
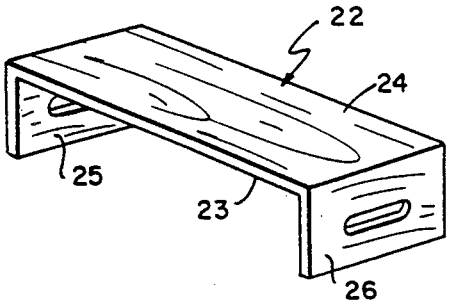
FIG. 2 is a perspective view of a flippable board oriented in a position suitable for defining a storage space when placed to rest upon a cabinet body.
Figure 3:
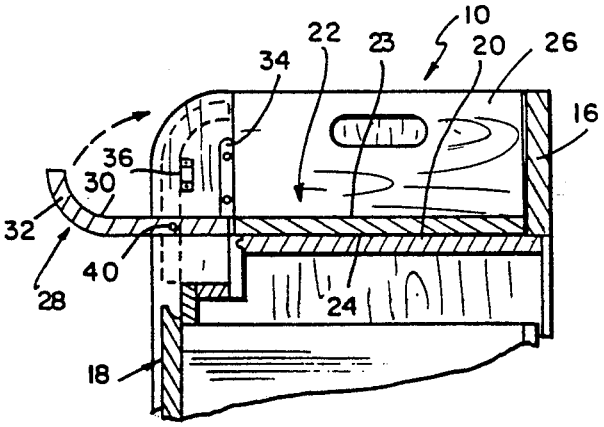
FIG. 3 is a schematic side view broken away to illustrate a front cabinet door in an extended position to form in conjunction with the flippable board a dressing table.
Figure 4:
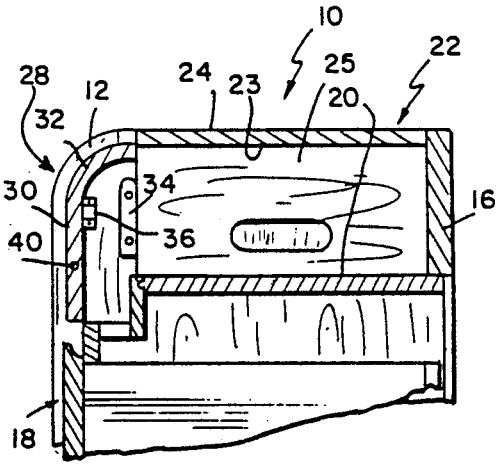
FIG. 4 is a side section illustrating the front cabinet door in a closed position and the flippable board oriented to define a storage space when placed to rest upon the cabinet body.

The convertible dresser 10 is shown in FIGS. 1 and 3 with the flippable board 22 oriented so that the second surface 24 contacts and supports the flippable board 22. In this configuration, the complex between the cabinet body 11 and the flippable board 22 forms a dressing table suitable for use with infants. If desired, the orientation of the flippable board 22 can be reversed, so that the first and second support rest upon the top support board 20 of the cabinet body 11, as shown in FIGS. 2 and 4. A storage space (not shown) is defined in part by the first surface 23, the top support board 20, and the first and second supports 25 and 26 of flippable board 22 when the flippable board 22 is oriented in this manner.

The usefulness of the convertible dresser 10 is further augmented by providing the cabinet body 11 with a front cabinet door 28 as shown in FIG. 1 and FIGS. 3 and 4. The front cabinet door 28 can be configured to either extend the horizontal surface suitable for use as as a dressing table, such as shown in FIG. 1 and 3, or can be used to cover the storage space defined by the flippable board 22 and the top board 20, as shown in FIG. 4.

The front cabinet door 28 has a flat portion 30 and a curved portion 32. The front cabinet door 28 is swingably mounted between the first and second side panels 12 and 14 using pins 40 that permit the front cabinet door to swing forward from a substantially vertical position into a horizontal position with the flat portion 30 lying coplanar to flippable board 22. The forward swinging action of the front cabinet door is halted with the aid of blocks 34 attached to the first and second side panels 12 and 14.

When the flippable board 22 is oriented to define a storage sPace, the front cabinet door 28 act to provide a moveable cover for that storage space. The front cabinet door 22 can be swung forward to permit access to that storage space, or can be closed as shown in FIGS. 3 and 4 to block access to the storage space. In operation, closure of the front cabinet door 28 involves swinging the front cabinet door 28 forward until forward motion is halted by stops 36 attached to the first and second side panels 28. In the embodiment illustrated, the stops 36 are positioned so that the front cabinet door 28 is oriented in a substantially vertical position.

What is claimed is:

1. A cabinet that can be converted into a dressing table comprising:

a cabinet body having first and second side panels with front and back edges, with the first and second side panels situated in spaced apart parallel relationship, a back panel having a left edge attached to the back edge of the first side panel and a right edge attached to the back edge of the second side panel, an at least one drawer positioned between the first and second side panel, a front cabinet door, attached to the first and second side panels for swinging movement therebetween, the cabinet door arranged in an open positioned when positioned substantially perpendicular to the back panel and in a closed position when positioned parallel to the back panel, and a flippable board situated to lie stop the cabinet body above the an at least one drawer, the flippable board having a first and second surface, with first and second supports attached to the first surface, the first and second supports being arranged in parallel spaced apart relationship, the flippable board capable of assuming two orientations with respect to the cabinet body, respectively oriented in a first orientation with the second surface positioned to form a cabinet top of the cabinet body and a second orientation with the first surface positioned to form a dressing table having its first surface in alignment with the front cabinet door when the door is in its open position.

2. A cabinet that can be converted into a dressing table comprising:

a cabinet body having a top with first and second step panels extending thereabove and means for interconnecting the first and second side panels in spaced apart parallel relationship, a flippable board situated on the cabinet body top and having a first and second surface, with first and second supports being arranged in spaced apart relationship so that the flippable board is capable of assuming a first orientation resting on the cabinet body top on its first and second supports with the second surface positioned to form a cabinet top of the cabinet body in line with a top of the side panels and a second orientation resting on the second surface and with the first surface positioned to form a dressing table.

3. A cabinet that can be converted into a dressing table comprising, a cabinet body having a top with first and second side panels extending thereabove and means for interconnecting the first and second side panels in spaced apart parallel relationship, and a flippable board situated on the cabinet body top, the flippable board having a first and second surface, with first and second supports attached to the first surface, the first and second supports being arranged in spaced apart relationship so that the flippable board is capable of assuming a first orientation resting on the cabinet body top on its first and second supports and with the second surface positioned to form a cabinet top of the cabinet body which is in line with a top edge of side panels and a second orientation resting on the second surface and with the first surface positioned to form a dressing table.

* * * * *